US006250114B1

(12) United States Patent
Traenkle

(10) Patent No.: US 6,250,114 B1
(45) Date of Patent: Jun. 26, 2001

(54) ROLLER FOR GUIDING KNITWEAR PRODUCED ON A KNITTING MACHINE AND DEVICE CONSTRUCTED THEREWITH

(75) Inventor: Dietmar Traenkle, Balingen (DE)

(73) Assignee: Sipra Patententwicklungs- u. Beteiligungsgesellschaft mbH, Albstadt (DE)

( * ) Notice: Subject to any disclaimer, the term of this patent is extended or adjusted under 35 U.S.C. 154(b) by 0 days.

(21) Appl. No.: 09/573,793

(22) Filed: May 17, 2000

(30) Foreign Application Priority Data

May 19, 1999 (DE) ..... 199 23 810
Mar. 23, 2000 (DE) ..... 100 14 569

(51) Int. Cl.[7] ..... D04B 15/88
(52) U.S. Cl. ..... 66/152; 66/153; 66/147
(58) Field of Search ..... 66/147, 149 R, 66/151, 152, 153, 148; 492/21, 27, 38, 39, 40, 41, 47; 226/175, 176, 184, 180, 189, 190

(56) References Cited

U.S. PATENT DOCUMENTS 5,425,251 * 6/1995 Schmid et al. ..... 66/149 R
5,759,141 * 6/1998 Schmitz ..... 492/39
5,960,646 * 10/1999 Schmid et al. ..... 66/149 R

FOREIGN PATENT DOCUMENTS 1 680 242 7/1954 (DE) .
1 860 242 10/1962 (DE) .
2 156 142 5/1972 (DE) .
1 585 042 7/1974 (DE) .
39 37 990 C2 5/1995 (DE) .
691 21 291 T2 3/1997 (DE) .
1 118 547 7/1968 (GB) .
85/02633 6/1985 (WO) .

* cited by examiner

*Primary Examiner*—Danny Worrell
(74) *Attorney, Agent, or Firm*—Michael J. Striker

(57) ABSTRACT

A roller (1) for guiding knitwear produced on a knitting machine, with at least one stub shaft (3) of reduced cross-section projecting to the side of a middle part (2) and at least one first adjusting ring (16) which can be fixed on the stub shaft (3) to form an annular gap is described. The adjusting ring (6) has a first axial end (17) with an outer diameter corresponding to the outer diameter of the middle part (2) and a second axial end (17*a*) associated with the annular gap (22). In accordance with the invention the adjusting ring (16) is assembled from at least two shells (24, 25) adjoining one another along butt joints (FIG. 5).

18 Claims, 5 Drawing Sheets

ROLLER FOR GUIDING KNITWEAR PRODUCED ON A KNITTING MACHINE AND DEVICE CONSTRUCTED THEREWITH

BACKGROUND OF THE INVENTION

1. Field of the Invention

This invention relates to a roller for guiding knitwear produced on a knitting machine, with at least one stub shaft of reduced cross-section projecting to the side of a middle part and at least one first adjusting ring which can be fixed on one of the stub shafts to form annular gap and which has a first axial end with an outer diameter corresponding to the outer diameter of the middle part and a second axial end associated with the annular gap. The invention also relates to a device comprising such a roller.

2. Description of the Prior Art

Tubular or circular knitted knitwear is as a rule taken down from the loop forming region of the knitting machine by a take-down device having two or more take-down rollers, regardless of whether is it produced on a flat or a circular knitting machine. The take-down rollers form nips therebetween, into which the tubular kit or knitted hose is passed, laid flat and folded at its longitudinal edges. The knitwear is also pressed at its longitudinal edges by the nip action and is creased. The creased edges resulting from this load to persisting changes in the knitwear or in the yarns, especially with the production of fabrics plated with elastic threads or when using synthetic fibres, and cannot be removed, or can only be removed with difficulty, by subsequent treatment of finishing of the knitwear.

It is therefore already known to avoid the occurrence of such pressure creases in that the knitwear is cut in the longitudinal direction before passing through the take-down rollers and is then spread out flat and then wound up in a single layer (DE 691 21 291 T2). Compared with the normal technique a double width take-down device is therefore required, which is expensive and undesirable for reasons of space. Moreover a greater space from the loop forming region has to be kept for the spreading out flat and winding up in a single layer, since the stitch rows which are normally straight and parallel to one another otherwise suffer strong wavy distortion, so that in addition to the wide construction of the machine there is also a higher construction, or else distorted stitch rows are obtained. In on the other hand the knitwear is cut in the longitudinal direction at two diametrically opposite places, which is also known (DE 39 37 990 C2), and the two layers thereby obtained are wound up with separate winding rollers, not only is a second winding roller necessary, with an increased cost of construction, but only half width fabric is obtained compared with the conventional technique.

In order to avoid such structural changes, take-down rollers are known (DE-GM 1 680 242) which are provided with reduction in diameter at a fixed axial position, forming an annular gap at each of its ends, where the creased edges normally come to lie. Since the hose width of knitting can vary, depending on the selected knitting construction, the yarn and other influential values, a special take-down roller has to be made for each fabric with and mounted in bearings, which is expensive and can result in frequent stoppages of the knitting machine. It is therefore also already known (DE-PS 1 585 042, DE-GM 1 860 242, GB-PS 1 118 547) to make the position of this annual gap variable in the axial direction of the take-down roller, in order to make it possible for the side edges to lie always with only a short section in the annular gap. The production of the annular gap and the adjustment of its position are effected as a rule with the aid of adjusting rings, which can be fitted against the end faces of a middle part of the take-down roller, or removed therefrom, their outer diameter corresponding to that of the middle part and it being possible to do this in part without dismantling the take-down roller. However the known constructions have the disadvantage that the adjusting rings have to have comparatively sharp edges at their side edges, formed by 90° corners, so that in all conceivable settings, on one side they continue flush with the outer periphery of the middle part of the take-down roller or an adjusting ring lying against this, while on the other side they either adjoin an annular gap or continue flush into the outer periphery of a further adjusting ring. These sharp edges bear at least in part on the knitwear as it is taken down and then often lead to impressions and/or indentations therein, which can involve remanent changes which cannot be obviated by further treatment, or only with difficulty.

Corresponding problems can result in guiding knitwear of the kind described with other rollers, e.g. in guiding by means of a winding roller or in the gap between a winding roller and a drive roller associated therewith.

SUMMARY OF THE INVENTION

It is, therefore, an object of this invention to design the roller above specified such that the formation of impressions and/or indentations in the knitwear can be largely avoided when required.

A further object of this invention is to provide a roller of the kind specified above such that the knitwear can be guided more gently than heretofore.

Yet another object of this invention is to make the design such that it is still possible to alter the position of the described gap without dismantling the roller and with simple means.

A further object of this invention is to provide a device comprising at least one such roller.

These and other objects of this invention are solved by a roller which is characterized in that the adjusting ring is assembled from at least two shells adjoining one another along hairline butt joints.

A device of this invention on a knitting machine with at least two rollers pressed together to guide knitwear produced as a tube on a knitting machine and flattened is characterized in that at least one of the rollers is formed in accordance with this invention and that the annular gaps form at least one free space receiving a side edge of the knitwear.

Further advantages features of the invention appear from the dependent claims.

BRIEF DESCRIPTION OF THE DRAWINGS

The invention will now be explained in more detail in conjunction with the accompanying drawings of an embodiment, in which.

DETAILED DESCRIPTION OF THE INVENTION

Figure 1:
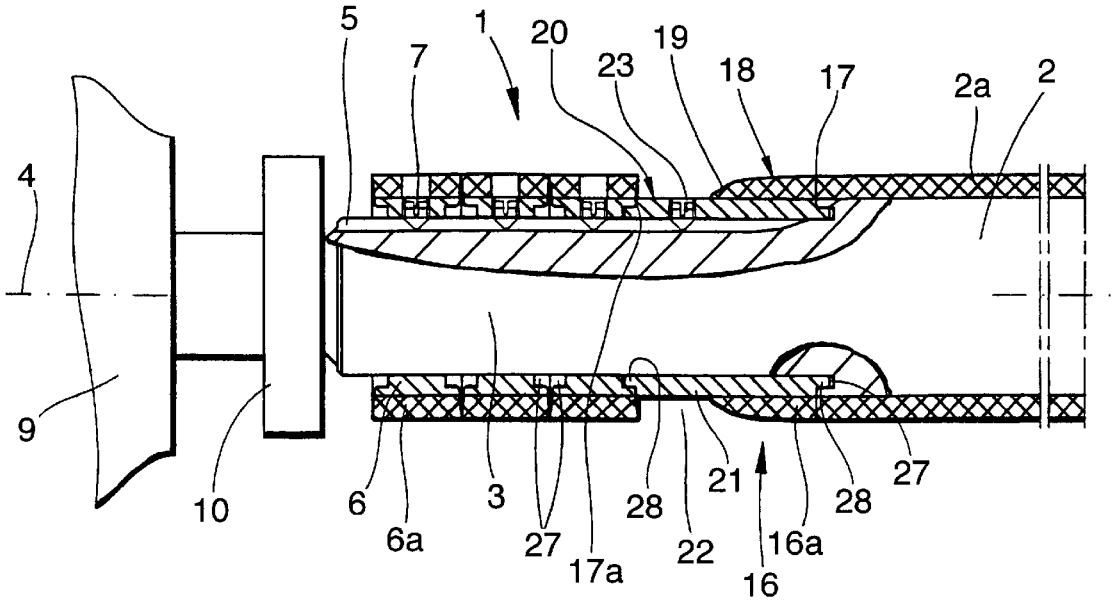
FIG. 1 is a schematic longitudinal section through the left part of a roller according to the invention, in the form of a take-down roller.

According to FIG. 1 a roller 1 in the form of a take-down roller in the embodiment has a middle part 2 and two stub shafts projecting from the ends of this, only a left stub shaft 3 being shown in each case in the drawings. The middle part 2 and the stub shaft 3 are coaxial with a common longitudinal axis 4 and have cylindrical peripheral sections, the outer diameter of the middle part 2 being greater than that of the stub shaft 3. The peripheral surface of the middle part 2 is preferably formed by a surrounding non-slip covering 2*a*. The stub shaft 3 has a groove 5 in its outer peripheral surface, running parallel to the longitudinal axis 4.

A first adjusting ring 6 is advantageously mounted on the stub shaft 3 and can be pushed along parallel to the axis 4 and be fixed in any arbitrary position in the axial direction. To this end the adjusting ring 6 has a radial threaded bore, into which a clamping screw 7 in the form of a grub screw can be screwed. The axial fixing is effected in that the adjusting ring 6 is turned about the axis 4 until the clamping screw 7 is aligned with the groove 5 and the clamping screw 7 is then tightened and thereby clamped against the bottom of the groove. The adjusting ring 6 is moreover secured in this way against turning relative to the stub shaft 3.

In the embodiment three preferably identical adjusting rings 6 are arranged on the stub shaft 3. The number of the adjusting rings 6 is however arbitrary in principle and dependent on how many adjusting rings 6 need to be fitted on to the stub shaft 3. The peripheral surfaces of the adjusting rings 6 are preferably formed by surrounding non-slip coverings 6*a,* whose outer diameters correspond throughout to the outer diameter of the middle part 2.

Figure 2:
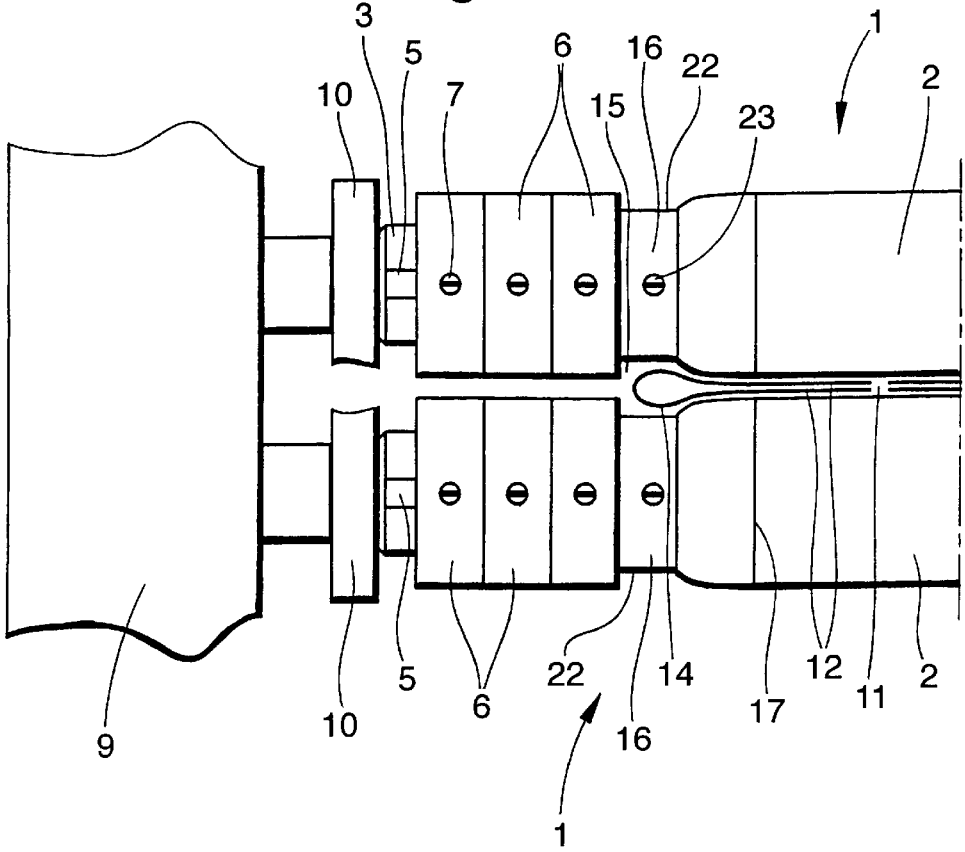
FIG. 2 is a plan view of a take-down device according to the invention, with two rollers according to FIG. 1 forming a nip for knitwear, to a somewhat reduced scale.

As FIGS. 1 and 2 in particular show the free end of the stub shaft 3 is journalled rotatably by means of a bearing in an upright support 9 of a knitting machine, not shown, where the upright support 9 of a circular knitting machine with a rotatable needle cylinder can be rotated together with this about its central axis. The drive to the take-down roller 1 is effected in known manner, e.g. with the aid of a drive gearwheel 10 fixed on the stub shaft 3. Moreover two or three like take-down rollers 1 (FIG. 2) are normally arranged parallel to one another and from a normal take-down device for knitting machines and leave a nip 11 therebetween, in which knitwear 12 indicated schematically in FIG. 2 is passed, consisting of flattened hose which accordingly forms two layers. One of the two longitudinal edges 14 of the knitwear 12 projects into a space 15 left free between the adjusting rings 6 and the middle part 2 of the take-down roller 1 (FIG. 2), whereby its outer edge can be folded over round a comparatively large radius and a sharp creased edge is avoided.

Take-down devices of this kind are generally known from the references cited initially and do not therefore have to be explained in more detail to the man skilled in the art.

In accordance with the invention the take-down roller 1 has a second adjusting ring 16 on each of the two ends of the middle part 2. This comprises, in accordance with the embodiment shown in FIGS. 1 and 2 and believed at present to be the best, a first axial end 17 with an outer diameter corresponding to the outer diameter of the middle part 2, at one side which faces the middle part 2 and is adapted to abut this, this diameter gradually reducing along a transition section 18 to a second axial end 17*a* of the adjusting ring 16 remote from the middle part 2. The outer diameter preferably reduces in accordance with FIGS. 1 and 2 along a gently curved arc 19 to about the axial middle of the adjusting ring 16, where the transition section 18 finishes and preferably passes without a step into a section 20 which as a substantially constant, reduced cross-section up to the other end. Alternatively it would equally be possible to reduce the outer diameter or outer cross-section gradually and continuously from one end face of the first end 17 up to the second end 17*a* of the second adjusting ring 16, i.e. leave out the section 20.

In the embodiment the second adjusting ring 16 is formed by an inner sleeve 21 and a covering 16*a* of a non-slip material applied to this, where the sleeve 21 has the same outer cross-sectional shape over its whole length. The transition section 18 in this case forms a transition from the covering 16*a* to the inner sleeve 21. The arrangement is advantageously such that the end 17 and the transition section 18 are each formed in the covering 16*a* while the section 20 is formed by the sleeve 21.

In the embodiment according to FIG. 1 the second adjusting ring 16 has its first end 17 lying against the middle part 2 and its second end 17*a* against a first adjusting ring 6. The outer peripheral surface of the middle part 2 goes flush into the outer peripheral surface of the second adjusting ring 16, while at the same time the outer diameter of the take-down roller 1 reduces only gradually or even not at all at least in a region directly adjoining the middle part 2 and is then reduced along an arc to a smaller value of the section 20, with formation of an annular gap 22. There is then a jump to a diameter corresponding to the outer diameter of the middle part 2 at the boundary surface with the adjoining first adjusting ring 6. The formation of the annular gap 22 is therefore not formed as is otherwise usual between the first adjusting ring 6 and the middle part 2 or between two first adjusting rings 6 of the stub shaft 3, but in the region of the second adjusting ring 16, i.e, at its second end 17*a* associated with the annular gap 22.

According to FIG. 2 the arrangement and design of the two take-down rollers 1 forming the nip 11 is preferably identical, so that the free space 15 for the knitwear 12 results from the cooperation of two like annular gaps 22. Alternatively it would however also be possible to provide only one of the two-down rollers 1 with a second adjusting ring 16 forming the annular gap 22, in which case the smallest outer diameter of the second adjusting ring 16 could be made somewhat smaller than is indicated in FIGS. 1 and 2 if required.

Moreover the second adjusting rings 16 are provided with radial threaded bores for reception of clamping screws 23, which have the same function as the clamping screws 7 and serve in particular to secure the second adjusting ring 16 against rotation, while their heads are preferably recessed radially like the clamping screws 7.

In order that the axial location of the second adjusting ring 16 with the annular gap 22 may be altered, without dismantling the take-down roller 1, the adjusting ring 16 is assembled according to the invention from at least two shells 24, 25 (FIGS. 3 to 8), which meet one another along hairline butt joints 26 preferably running along generator lines. As FIG. 5 in particular shows, where the shells 24, 25 are also shown in end view turned through 90° , the second adjusting rings 16 are preferably each composed of two half shells, wherein at least one half shell is provided with the radial bore receiving the clamping screw 23.

The first and second adjusting rings 6, 16 and the middle part 2 are preferably provided at their ends with connecting means which can be fitted into one another and act to effect form locking or interlocking connection at least in the radial direction. In the embodiment these connecting means include on the one hand annular grooves or recesses 27 (FIG. 1), which are formed in the ends of the middle part 2 and of the first adjusting rings 6, and on the other hand annular lips 28, which are formed on the axial ends 17, 17*a* of the second adjusting ring 16 and fit closely in the grooves 27. Accordingly, if the second adjusting rings 16 are arranged without axial play between two first adjusting rings 6 or between a first adjusting ring 6 and the middle part 2, the lips 28 automatically engage in the grooves 27, whereby the two shells 24, 25 are fixed radially and axially. The clamping screws 23 serve in this case merely to secure against rotation. Alternatively the grooves 27 could be provided in the adjusting rings 16 and the lips 28 on the adjusting rings 6 and the middle part 2.

It is moreover clear that the take-down rollers 1 could be provided also or only at their right ends, not shown in the drawings, with corresponding stub shafts 3 and corresponding first and second adjusting rings 6, 16, in order to affect the opposite fabric edge (longitudinal edge 14). If the knitwear is cut along one longitudinal edge 14, an annular gap 22 needs to be provided only at the opposite end of the take-down roller 1.

The operation of the take-down roller according to the invention is as follows:

In FIGS. 1 and 2 it is assumed that a second adjusting ring 16 forming an annular gap 22 is arranged at the left end of each take-down roller 1 between three first adjusting rings 6 abutting one another and the middle part 2 and all adjusting rings 6, 16 and the middle part 2 adjoin one another at their ends in hairline butt joints. The position of the longitudinal edge 14 of the knitwear 12 appears from FIG. 2. The coverings 2*a,* 16*a* pass flush into one another.

Figure 3:
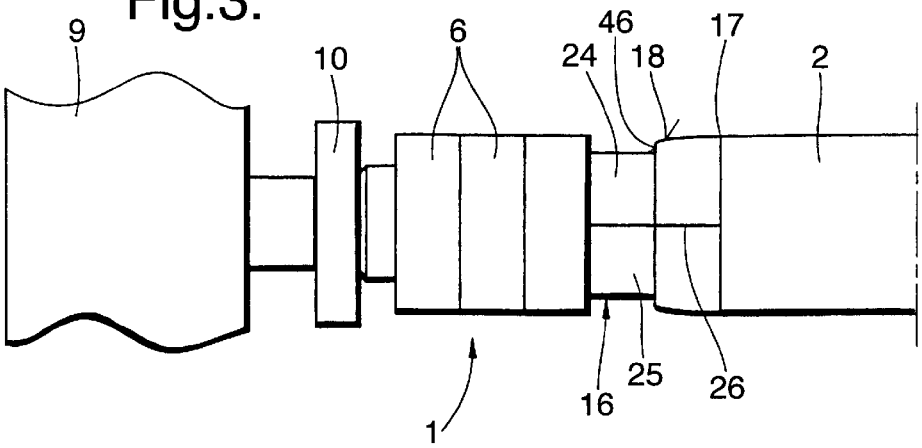
FIGS. 3 to 8 show different operating states of the roller according to FIG. 1 during the alteration of the position of an annular gap, each in a front view or plan view.
Figure 4:
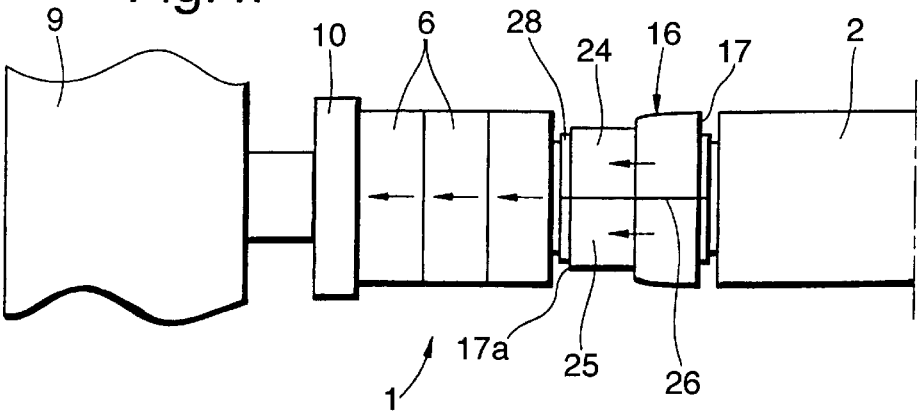
Figure 5:
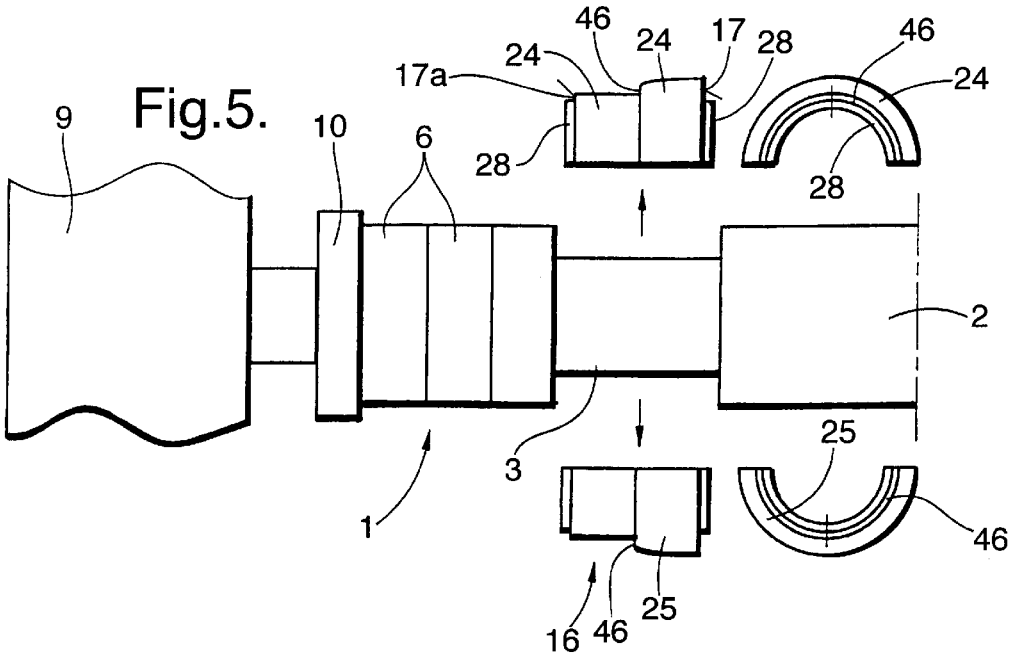
Figure 6:
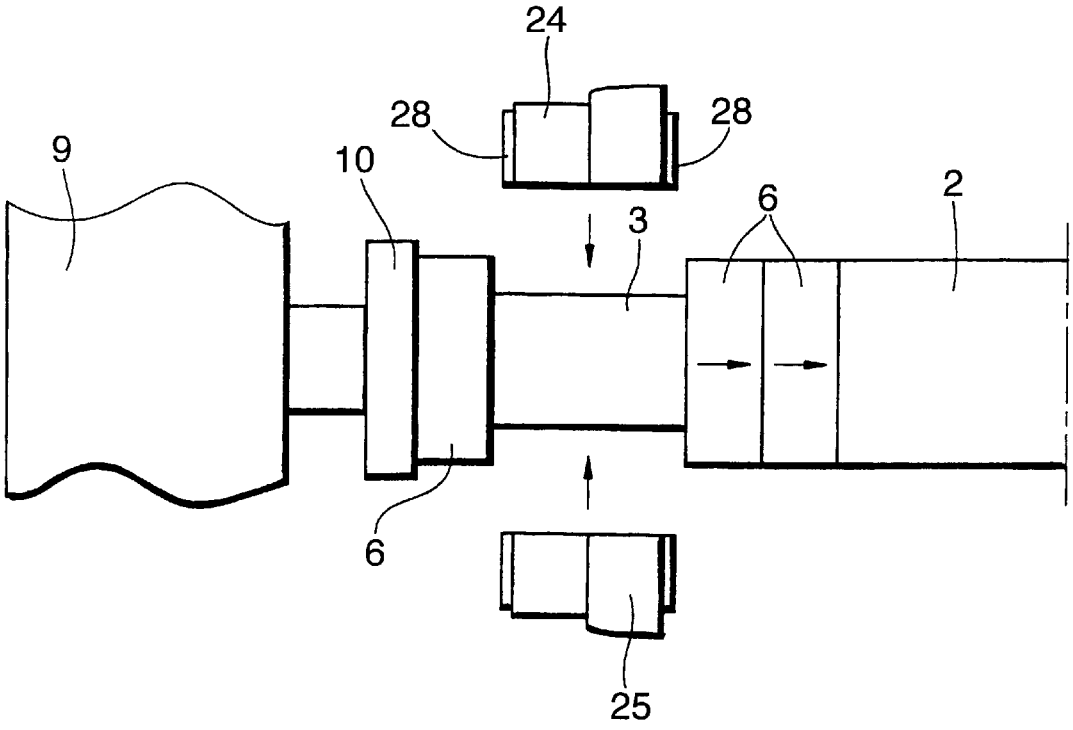
Figure 7:
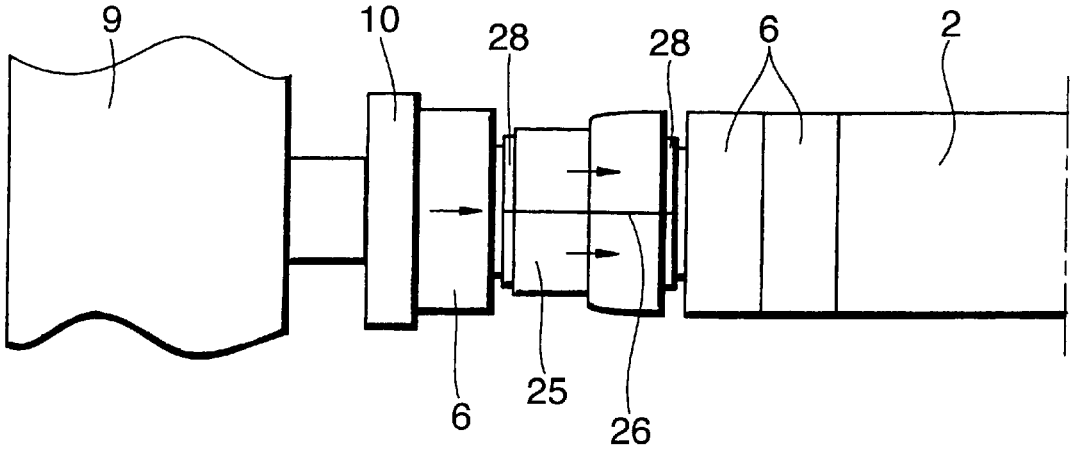
Figure 8:
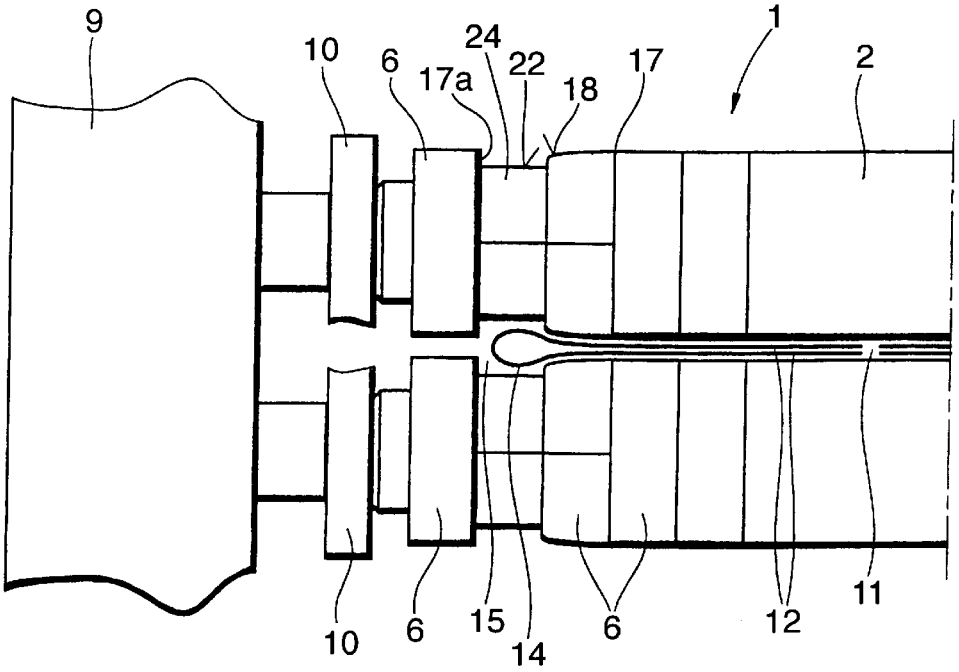

If knitwear 12 whose width is greater than in FIG. 2 is to be taken down with the take-down device shown in FIG. 2, starting for example from the arrangement according to FIG. 3, the clamping screws 7, 23 of the first and second adjusting rings 6, 16 are first released. The adjusting rings 6 are then pushed to the left, as is indicated in FIG. 4 by the added arrows, so that the lips 28 of the second adjusting ring 16 comes out of the associated groove 27 of the adjoining first adjusting ring 6 and then the second adjusting ring 16 can also be released from its engagement with the middle part 2 by shifting to the left in the arrow direction. A large enough axial spacing is provided for this purpose between the first adjusting ring 6 furthest to the left in FIGS. 1 and 2 and the associated drive gearwheel 10, which allows the axial displacement of the adjusting rings 6, 16. The two half shells 24, 25 are then lifted radially off the stub shaft 3 (FIG. 5). Subsequently two first adjusting rings 6 are in this embodiment shifted to the right in the arrow direction (FIG. 6), until they abut the middle part 2, whereafter the two shells 24, 25 are fitted on the stub shaft 3 again in the radial direction, in accordance with the arrows in FIG. 6, however at a location lying axially further out compared with FIG. 3. Finally the shells 24, 25 of the second adjusting ring 16 are pushed axially toward the middle part 2 and therefore brought into engagement with the adjoining first adjusting ring 6 on the right in FIG. 7, whereafter the first adjusting ring 6 at the far left in FIG. 7 is pushed to the right. Finally the adjusting rings 6, 16 are fixed by the clamping screws 7, 23, whereby the arrangement according to FIG. 8 results, with corresponding treatment of the second take-down roller 1 also. The free space 15 formed by the annular gaps 22 of the take-down rollers 1 is however displaced outwards compared with FIG. 3 by the width of two first adjusting rings 6, so that the knitwear 12 can be wider by a corresponding amount and nevertheless have its side edge 14 again located in the space 15. The same applies to right end of the take-down device, not shown in FIGS. 3 to 8. The covering 2*a,* 6*a* and 16*a* (FIG. 1) all merge flush into one another on the side of the middle part 2, so that in this operative state also no sharp edged transitions in the region of the transition section 18 to the annular gaps 22 are possible.

Alternatively it would also be possible to assemble the first adjoining rings 6 from at least two shells, which can be fitted and dismantled radially and to fix them fast against rotation and axial movement on the stub shaft 3 by means of suitable fixing screws.

On the one hand the invention makes it possible to alter the axial location of the space 15 or the annular gaps 22 by comparatively simple means, without dismantling the take-down roller 1. On the other hand the substantial advantage which can be seen especially from FIGS. 2 to 8 is achieved that the reduction of the diameter of the take-down roller 1 is always effected along the relatively gently curved arc section 18 of the second adjustment ring 16, regardless of where the annular gap 22 or the second adjusting ring 16 comes to lie in the specific case. Moreover all peripheral sections concerned pass flush into one another, regardless of the position of the adjusting ring 16, except for the jump in diameter at the transition from the second adjusting ring 16 to the first adjusting ring 6 lying to the left thereof in FIG. 1, which is in the region immaterial to the formation. of creased edges. This accordingly avoids the take-down roller 1 having sharp corners or edges which could press against the knitwear 12 in the region of the nip 11 and damage it. In other words, particularly gentle taking down of the knitwear 12 is facilitated, independent of the width of the knitwear 12 in any particular case.

Figure 9:
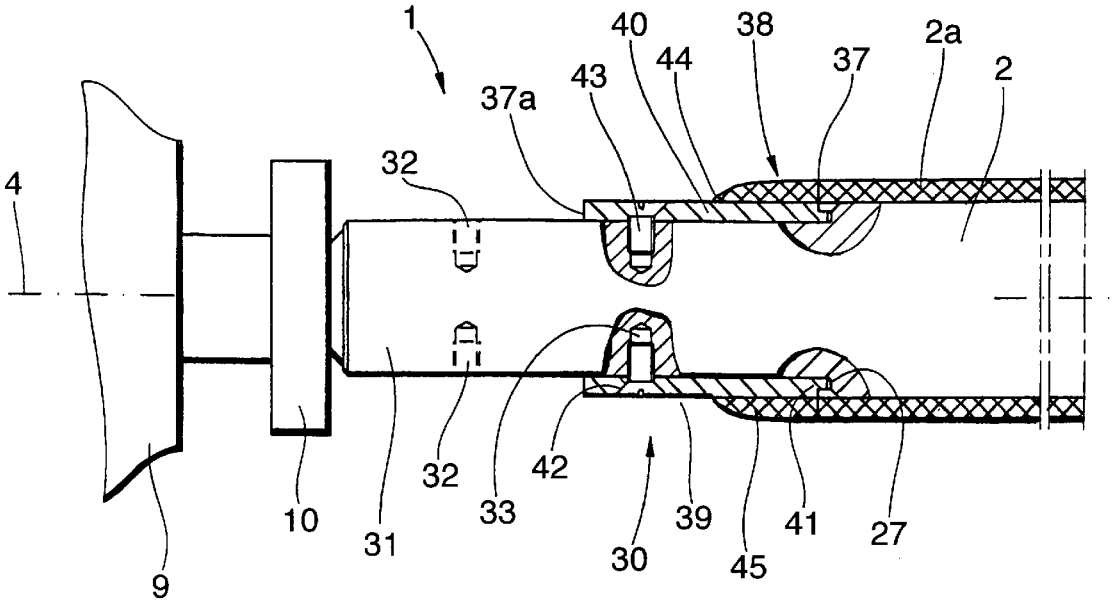
FIG. 9 shows a view corresponding to FIG. 1 of a second embodiment of an adjusting ring according to the invention.
Figure 10:
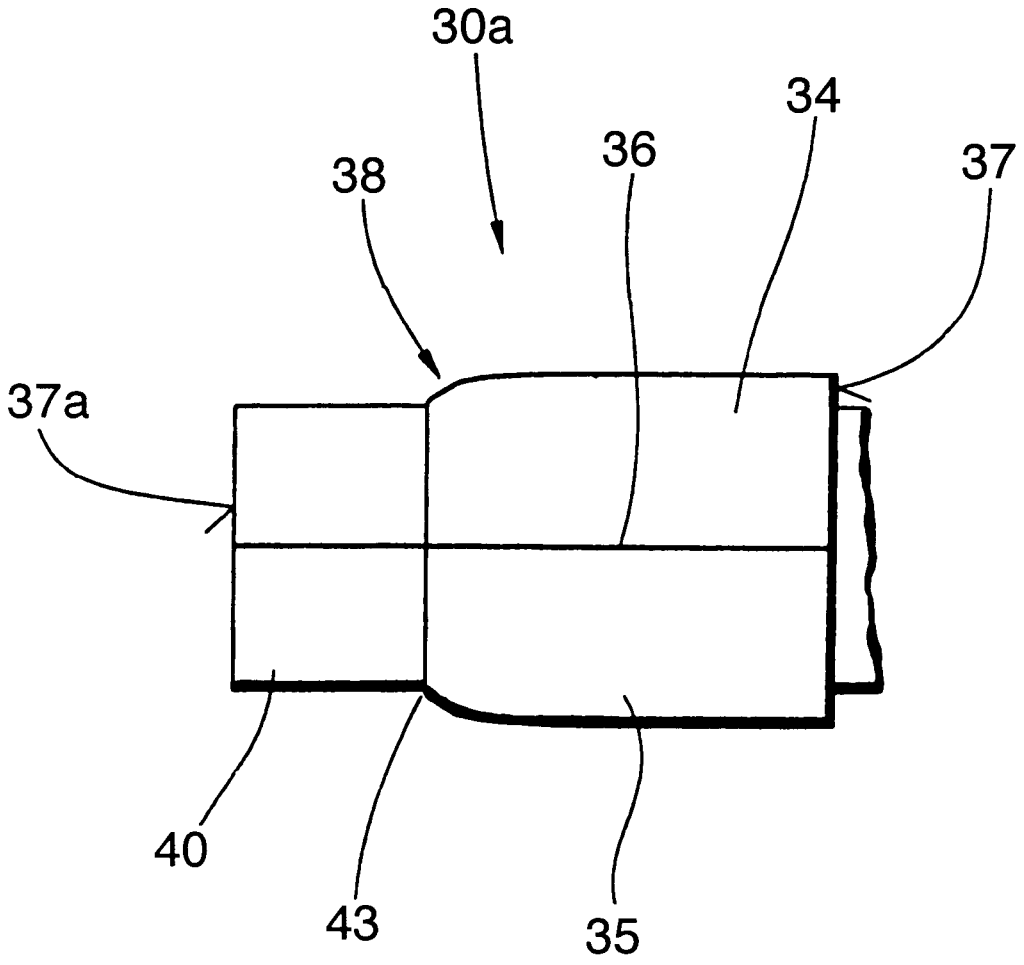
FIG. 10 is a side view of a second adjusting ring extended in the axial direction for the roller according to FIG. 9, in the assembled state.

In the embodiment described above the axial position of the annular gap 22 is determined by a suitable alteration in the axial position of the second adjusting ring 16. However, FIGS. 9 and 10 show an embodiment in which only at least one second adjusting ring 30 or 30*a* is provided, while the first adjusting rings 6 are omitted. Like parts are given the same reference numerals as in FIGS. 1 to 8.

In contrast to FIGS. 1 and 2, a left stub shaft 31 of the roller 1 has no longitudinal groove 5 but a plurality of threaded bores 32, 33 spaced in the direction of the axis 4 and formed in the peripheral surface, these being arranged in pairs opposite one another. The adjusting ring 30, 30*a* is composed of two shells 34, 35 (FIG. 10) as in FIGS. 1 to 8, these being formed as half shells and adjoining one another along hairline butt joints 36 in the mounted state on the stub shaft 31. The adjusting ring has two axial ends 37, 37*a,* a transition section 38 and a section 40 forming an annular gap 39. The transition section 38 is preferably formed like the transition section 18 according to FIGS. 1 to 8, i.e. with an outer peripheral surface whose outer diameter falls gradually from a value at the end 37 corresponding to the outer diameter of the middle part 2 to a smaller value in the region of the section 40. Lips 41 corresponding to the lips 28 (FIG. 1) are moreover provided at the end 37 and interlock in the grooves 27 of the middle part 2; they can be omitted at the other end 37*a*.

In contrast to FIGS. 1 to 8 each shell 34, 35 has at least one screw hole 42 in the region of the section 40, serving to receive the head of a fixing screw 43, which can be screwed through the screw hole 42 into a corresponding threaded bore 32 or 33, in order to fix the shell 34, 35 in question axially, radially and in the rotational direction immovably on the stub shaft 31. The fixing screws 43 are preferably formed as counter-sunk screws and are so disposed with their heads recessed into the screw holes 42 that they do not project beyond the surface of the section 40.

If it is desired, as in the case of FIGS. 1 to 8, to arrange the section 40 forming the annular gap 39 at different, selectable distances relative to the middle part 2, a plurality of adjusting rings 30, 30*a* are provided according to the invention and have different axial lengths, such that the transition section 38 passes into the section 40 at different axial positions 44 (FIG. 9), i.e. the axial distances of these places 44 from the respective first ends 37 have different values. It is advantageously provided that the transition sections 38 of all adjusting rings 30 or 30*a* provided have the same axial length, so that the same conditions for the longitudinal edge 14 (FIG. 2) of the knitwear 12 always result, independent of the length of the adjusting rings 30, 30*a,* as a comparison between FIGS. 9 and 10 shows, in which the sections 40 have the same axial lengths. It would however also be possible to make all adjusting rings 30, 30*a* of the same axial length and make both the sections 40 and the transition sections 38 of different lengths.

The axial and radial positions of the screw holes 42 and the axial position of the threaded bores 32, 33 are so selected that each available adjusting ring 30 of a set consisting of a plurality of adjusting rings 30, 30*a* of different axial lengths can be so mounted on the stub shaft 31 that, on the one hand, the first ends 37 abut an associated end surface of the middle part 2, on the other hand the two shells 34, 35 form the hairline butt joints 36 visible in FIG. 10. Thus for example the threaded bores 33 in FIG. 9 serve to receive the fixing screws 43 of a comparatively short adjusting ring 30, whereas the threaded bores 32 are used when an axially longer adjusting ring 30*a* is used, which covers the threaded bores 33 with its transition section 38 for example. If all adjusting rings 30, 30*a* have the same length only one pair of threaded bores (e.g. 32) needed be provided.

The fitting and dismantling of the adjusting rings 30, 30*a* is like the fitting and dismantling of the adjusting rings 16. To effect removal the shells 34, 35 are firstly shifted axially somewhat (in FIG. 9 to the left) after releasing the fixing screws 43, in order to separate the lips 41 from the grooves 27, and are then lifted radially off the associated stub shaft 31, while fitting is effected in the inverse sequence.

The invention essentially provides the advantage that the take-down roller 1 acts extremely gently on the knitwear 12 to be taken down, on account of its curved section 18 or 38, since sharp edges coming into contact with the knitwear 12 or associated with its edges are completely absent. Impressions and/or indentations in the knitwear 12 are therefore avoided.

The invention is not limited to the described embodiments, which can be modified in may ways. In particular it would be possible to make the middle part and the adjusting rings 6, 26, 30, 30*a* or their shells in one piece and to provide them with smooth or if desired corrugated or toothed surfaces instead of surfaces with non-slip coverings 2*a,* 6*a,* 16*a* or 45, while naturally the adjusting rings 16, 30, 30*a* could also be denoted the first and the adjusting rings 6 the second adjusting rings. Furthermore the transition sections 18, 30 can have other shapes (roundings) than as seen in drawings. This is indicated in FIGS. 2 to 8 for example, where the transition sections 18 merge into the section 20 forming the annular gap 22 over a small radial step 46 (FIGS. 3 to 5). Moreover it would be possible to let the transition section 18, 38 end at the end 17*a,* 37*a* remote from the middle part 2 and omit the section 20, 40 completely, in which case the transition section 18, 38 and optionally a part of the adjoining stub shaft 3, 31 would form the annual gap 22, 39. It would also be possible to give the stub shafts 3, 31 non-circular cross-sections, in which case special securing against rotation of the adjusting rings 6, 16, 30, 30*a* would not be necessary. Also the shaping of the annular gap 22, 39 in the region of the second adjusting rings 16, 30, 30*a* could be different from what is shown in FIGS. 1 to 10 and the same applies to the connecting means 27, 28 and 41 shown only by way of example, which could equally be formed by pins and bores associated therewith for example. In particular the connecting means 27, 28 and 41 could be omitted completely when each shell 34, 35 is, as in FIGS. 9 and 10, fixed with an associated fixing screw 43 on the stub shaft 31. Furthermore the described rollers 1 can be used for purposes other than taking down the knitwear, especially as drive rollers for winding rollers for example, on which the knitwear taken down by the take-down rollers is wound. The winding roller itself can be made like the described roller 1. Finally it will be understood that the individual features of the rollers 1 can be used in combinations other than those shown and described.

It will be understood that each of the elements described above, or two or more together, may also find a useful application in other types of constructions differing from the types described above.

While the invention has been illustrated and described as embodied in a circular knitting machine and a control device therefor, it is not intended to be limited to the details shown, since various modifications and struktural changes may be made without departing in any way from the spirit of the present invention.

Without further analysis, the foregoing will so fully reveal the gist of the present invention that others can, by applying current knowledge, readily adapt it for various applications without omitting features that, from the standpoint or prior art, fairly constitute essential characteristics of the generic or specific aspects of this invention.

What is claimed as new and desired to be protected by Letters Patent is set forth in the appended claims.

What is claimed is:

1. A roller for guiding knitwear (12) produced on a knitting machine, comprising:

a middle part (2), at least one stub shaft (3, 31) having a cross-section which is smaller than a cross-section of the middle part (2) and projecting to a side of said middle part (2) and at least one first adjusting ring (16, 30, 30*a*) which is fixed on said stub shaft (3, 31) to form an annular gap (22, 39) and which has a first axial end (17, 37) with an outer diameter corresponding to an outer diameter of the middle part (2) and a second axial end (17*a,* 37*a*) located near the annular gap (22, 39), said adjusting ring (16, 30, 30*a*) having at least two shells (24, 25 or 34, 35) adjoining one another along butt joints (26, 34).

2. A roller according to claim 1, wherein said adjusting ring (16, 30, 30*a*) has two ends (17, 37; 17*a,* 37*a*), a transition section (18, 38) lying between said two ends (17, 37; 17*a,* 37*a*), and an outer diameter, said diameter gradually reducing from an outer diameter of said middle part (2) in the direction of said second end (17*a,* 37*a*) associated with said annular gap (22, 39).

3. A roller according to claim 2, comprising a plurality of first adjusting rings (30, 30*a*) being provided with different axial lengths to form axially differently arranged annular gaps (39).

4. A roller according to claim 3, wherein said transition section (38) of all first adjusting rings (30, 30*a*) have the same axial lengths.

5. A roller according to claim 2, wherein said adjusting ring (16, 30, 30*a*) has a section (20, 40) with a constant outer diameter, said diameter being reduced compared with an outer diameter of said middle part (2) to form the annular gap (22, 39), adjoining the transition section (18, 38).

6. A roller according to claim 5, wherein said section (20, 40) forming the annual gap (22, 39) has an outer diameter which corresponds to an outer diameter of an end of said transition section (18, 38) remote from said first end (17, 37).

7. A roller according to claim 1, wherein both shells (34, 35) are provided with screw holes (42) and the at least one stub shaft (31) is provided with radial threaded bores (32, 33) to receive fixing screws (43) passing through the screw holes (42), wherein the axial positions of the screw holes (42) and threaded bores (32, 33) are so selected that the first end (37) of the adjusting ring (30, 30*a*) abuts and associated end surface of the middle part (2) in a fitted state.

8. A roller according to claim 3, wherein both shells (34, 35) are provided with screw holes (42) and that the at least one stub shaft (31) is provided with radial threaded bores (32, 33) to receive fixing screws (43) passing through the screw holes (42), wherein the axial positions of the screw holes (42) and threaded bores (32, 33) are so selected that all first adjusting rings (30, 30*a*) can abut with the first ends (37) on an associated end surface of said middle part (2) in a fitted state.

9. A roller according to claim 1, wherein at least one second adjusting ring (6) is slidably mounted on and capable of being fixed on the stub shaft (3), said second adjusting ring (6) having an outer diameter corresponding to an outer diameter of said middle part (2).

10. A roller according to claim 9, wherein said shells (24, 25) said middle part (2) and said second adjusting ring (6) are provided at axial ends with connecting means which can be fitted into one another and act to effect interlocking in a radial direction.

11. A roller according to claim 10, wherein said connecting means consist of annular grooves (27) and lips (28) on the axial ends.

12. A roller according to claim 1, wherein said stub shaft (3) is provided with grooves (5) parallel to an axis (4) of said roller and wherein said adjusting rings (6, 16) are provided with radial clamping screws (7) adapted to be screwed into said grooves (5).

13. A roller according to claim 12, wherein a radial clamping screw (23) adapted to be screwed into the grooves (5) is associated with at least one of said shells (24, 25) of each first adjusting ring (16).

14. A roller according to claim 1, wherein said adjusting rings (16, 30, 30*a*) and said middle part (2) consist of sleeves (21) and non-slip coverings (2*a*, 6*a*, 16*a*, 45) applied said sleeves (21).

15. A roller according to claim 5, wherein said section (20, 40) of said annular gap (22, 39) is formed by an inner sleeve (21) whereas said transition section (18) is formed by a covering (16*a*, 45).

16. A roller according to claim 1, being designed in the form of a take-down roller (1).

17. A roller according to claim 1, being designed in the form of a drive roller for a winding roller.

18. A device on a knitting machine with at least two rollers (1) pressed together to guide knitwear (12) produced as a tube on a knitting machine and flattened, wherein at least one of the rollers (1) comprises a middle part (2), at least one stub shaft (3, 31) having a cross-section which is smaller than a cross-section of the middle part (2) and projecting to a side of said middle part (2), and at least one first adjusting ring (16, 30, 30*a*) which is fixed on said stub shaft (3, 31) to form an annular gap (22, 39) and which has a first axial end (17, 37) with an outer diameter corresponding to an outer diameter of said middle part (2) and a second axial end (17*a*, 37*a*) located near said annular gap (22, 39), said adjusting ring (16, 30, 30*a*) being assembled from at least two shells (24, 25 or 34, 35) adjoining one another along butt joints (26, 34), and said annular gap (22, 39) forming at least one free space (15) receiving a side edge (14) of a said knitwear (12).

* * * * *